US006878100B2

(12) United States Patent
Frykman et al.

(10) Patent No.: US 6,878,100 B2
(45) Date of Patent: Apr. 12, 2005

(54) FORCE SENSING TREADMILL

(75) Inventors: Peter N. Frykman, Natick, MA (US); Everett A. Harman, Natick, MA (US); Michael E. LaFiandra, Merrimack, NH (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 106 days.

(21) Appl. No.: 10/393,349

(22) Filed: Mar. 21, 2003

(65) Prior Publication Data

US 2004/0242377 A1 Dec. 2, 2004

Related U.S. Application Data

(60) Provisional application No. 60/368,807, filed on Mar. 21, 2002.

(51) Int. Cl.[7] ..... A63B 22/00
(52) U.S. Cl. ..... 482/54; 482/51
(58) Field of Search ..... 482/51, 54; 600/587, 600/595, 592

(56) References Cited

U.S. PATENT DOCUMENTS

| | | | | |
|---|---|---|---|---|
| 5,299,454 | A | 4/1994 | Fuglewicz et al. | |
| 5,474,087 | A | 12/1995 | Nashner | |
| 5,623,944 | A | 4/1997 | Nashner | |
| 6,010,465 | A | 1/2000 | Nashner | |
| 6,173,608 | B1 | 1/2001 | Belli et al. | |
| 6,231,527 | B1 * | 5/2001 | Sol | 600/595 |
| 6,645,126 | B1 * | 11/2003 | Martin et al. | 482/54 |
| 2003/0013584 | A1 | 1/2003 | Harney | |

OTHER PUBLICATIONS

Belli et al., "A Treadmill Ergometer for Three–dimensional Ground Reaction Forces Measurement During Walking," Journal of Biomechanics, 2001, pp. 105–112, vol. 34.
Kistler Instrument Corp., "Multicomponent Kit," pp. 1–4, (date unknown).
Kistler Instrument Corp., no title one page printout from www.kistler.ch/web/kistler_portal.nsf/urlnames/ws_multi_component_en!Open Document&Sub=KIC printed on Mar. 7, 2003.
John Morris Scientific, "Gaitway Instrumented Treadmill," printed from www.johnmorris.com.au/html/Kistler/bio_gaitway_treadmill.htm. on Mar. 17, 2003.
Oak Ridge National Laboratory, "Fact Sheet: Foot Force–Torque Sensor," UT–Battelle for the Department of Army.
TEKSCAN, "Medical Sensor Catologe," revised Jan. 1, 2003, pp. 1–28.
Kaufman et al, "The Standard: Military Overuse Injury Prevention Research," Vicon Motion Systems, 1996, pp. 1–4, No. 2.

* cited by examiner

*Primary Examiner*—Glenn Richman
(74) *Attorney, Agent, or Firm*—Elizabeth Arwine

(57) ABSTRACT

A force sensing treadmill preferably including a pair of treadmills mounted in tandem, each on its own independent force platform attached to a common chassis. Preferably, each of the force platforms, which are separated by a minimal gap, provides a plurality of signals representing forces in the x-axis, y-axis, and z-axis, and torques about these three axes enabling separate information to be collected from the left and right foot during walking and running the entire time that either foot is in contact with the belt. The grade of the treadmill preferably can be changed from uphill to level to downhill and back without storming the belt or having the user stop walking or running. Each treadmill unit preferably includes a belt around a plurality of rollers and preferably within the space inside the belt is located the drive system and forceplate.

21 Claims, 7 Drawing Sheets

FORCE SENSING TREADMILL

This application claims the benefit of U.S. provisional Application Ser. No. 60/368,807, filed Mar. 21, 2002, which is hereby incorporated by reference.

I. FIELD OF THE INVENTION

This invention relates to a device for measuring force and torque in three dimensions for both the right and left feet during walking and/or running on a treadmill. More particularly, the invention is a force sensing treadmill that detects the forces and torques caused by an individual walking and/or running on a treadmill.

II. BACKGROUND OF THE INVENTION

The problem which the invention aims to solve is to provide biomechanists, physiologists, and orthopedists with a solution capable of measuring vertical and horizontal forces, i.e. tangential forces of footsteps, especially for several successive steps by advantageously, but not exhaustively, differentiating between the forces exerted by the right leg and those exerted by the left leg. In the event of rehabilitation following any injury or simply in order to monitor and test an individual, it is important to ascertain the forces exerted by each of the legs when, for example, walking or running normally.

Apparatus is known which can be used to measure angular variations between the tibia and femur corresponding, in particular, to movements of flexion and extension when walking. In contrast, such apparatus provides no indication of the forces exerted by the foot. It is the forces and torques exerted by the feet that allow an entire model and analysis to be done of the forces and torques in the joints and other connection points within the individual.

There are a variety of methods and devices that have been described in the prior art for determining quantities related to the position, magnitude and distribution of vertical forces exerted by a subject's foot (or two feet combined) against a support surface during standing or walking. The three commonly used methods and devices include coupled force transducers, instrumented shoes, and independent force transducers.

A. Coupled Force Transducers

One class of methods and devices uses a forceplate that typically is a flat, rigid surface that mechanically couples three but more often four linear force transducers. The typical forceplate includes linear force transducers coupled to a substantially rigid plate to form a single force measuring surface, and each provides a way by which the force measuring surface is used to quantify aspects of the forces exerted by the feet of a subject standing on the forceplate. The most commonly determined quantities used to describe the forces exerted on a standalone forceplate surface (i.e., not part of a treadmill) by an external body are the following: (1) the position (in the horizontal plane) of the center of the vertical axis component of force, (2) the magnitude of the vertical axis component of the center of force, and (3) the magnitude of the two horizontal axis components (anteroposterior and lateral) of the center of force. Calculation of position and magnitude quantities for the vertical axis component of the center of force requires that only the vertical force component be measured by each of the three (or four) mechanically coupled force transducers. To measure the horizontal axis components of force, the force transducers must also measure the horizontal plane components of force.

The exact form of the calculations required to determine the above described center of force position and magnitude quantities from the measurement signals of the linear force transducers depends on the number and positions of the force transducers. Specifically, these algorithms must take into account the known distances between the force measuring transducers.

When a forceplate is used to measure quantities related to the position of the center of force, the position quantity is always determined in relation to coordinates of the forceplate surface. If the position of the foot exerting the force on the surface is not precisely known in relation to the forceplate surface, or if the position of the foot changes with time relative to the surface, the position of the center of vertical force cannot be determined in relation to a specified anatomical feature of the foot.

In order to measure forces exerted by the foot, there are known systems which use a platform which rests on the floor and uses sensors. The platform is located along the path that is walked in order to obtain an image of the force exerted by a footstep. Nevertheless, it appears that such a solution is not satisfactory given the fact that the person has a natural tendency to pause (or at a minimum become self-conscious of the need to hit the forceplate and alter their gait) before walking onto the platform so that the force which is exerted is not natural. This system can be duplicated for each leg. This system is not suitable for the measurement of several consecutive steps, because different individuals have their own unique gait.

B. Instrumented Shoe

A second class of methods and devices described in the prior art for measuring quantities related to forces exerted by a foot against a supporting surface during standing and walking is a shoe in which the sole is instrumented with linear force transducers. The principles for determining the position of the center of vertical force exerted on the sole of the shoe by the subject's foot are mathematically similar to those used to calculate the position of the center of force quantities using the forceplate.

Because the position of an instrumented shoe is fixed in relation to the foot, the instrumented shoe can be used to determine the position of the center of vertical force in relation to coordinates of the foot, regardless of the position of the foot on the support surface. A disadvantage of the instrumented shoe is that the position of the center of vertical force cannot be determined in relation to the fixed support surface whenever the position of the foot on the support surface changes during the measurement process. Another disadvantage in a clinical environment is that the subject must be fitted with an instrumented shoe.

The position and the magnitude of the center of force exerted by a foot against the support surface are determined relative to anatomical features of the foot by embedding force transducers in the shoes of walking and running subjects. Measures of the timing of heel-strikes and toe-offs have been made using contact switches embedded in the subject's shoes.

C. Independent Force Transducers

A fundamentally different method and device described in the prior art for determining quantities related to the forces exerted on a standalone support surface utilizes a plurality of mechanically independent vertical force transducers. Each vertical force transducer measures the total vertical force exerted over a small sensing area. The independent transducers are arranged in a matrix to from a force sensing surface. The two-dimensional position in the horizontal plane and the magnitude of the vertical component of the center of force exerted on the sensing surface can be determined from the combined inputs of the mechanically independent transducers. When the vertical force transducers are not mechanically coupled, however, the accuracy of the center of vertical force position quantity will be lower, and depends on the sensitive area of each transducer and on the total number and arrangement of the transducers. When mechanically independent vertical force transducers are used to determine the position of the center of vertical force, the resulting quantities are determined in relation to coordinates of the force sensing surface.

The plurality of independent force measuring transducers can be used to determine additional quantities related to the distribution of forces exerted against a support surface by a subject's foot. Outlines of the foot can be produced by a system for mapping the distribution of pressures exerted by the foot on the surface. Usually the positions of anatomical features of the foot such as the heel, the ball, and the toes can be identified from the foot pressure maps. When the position of a first anatomical feature is determined in relation to the support surface by the pressure mapping means, the position of a second anatomical feature of the foot can be determined in relation to the support surface by the following procedure. The linear distance between the first and second anatomical features is determined. Then, the position of the second anatomical features in relation to the support surface is determined to be the position of the first anatomical feature in relation to the support surface plus the linear distance between the first and second anatomical features.

When a subject stands with a foot placed in a fixed position on the surface of a force sensing surface, the position of the center of force exerted by the foot can be determined in relation to coordinates of the forceplate surface. If the position of a specified anatomical feature of the foot (for example, the ankle joint) is also known in relation to the coordinates of the forceplate surface, the position of the center of force in relation to coordinates of the specified anatomical feature of the foot can be determined by a coordinate transformation in which the difference between the force and anatomical feature position quantities are calculated.

Forceplates, instrumented shoes and independent force transducers have all been used in the prior art to measure quantities related to the position and magnitude of the center of force exerted by each foot against the support surface during stepping-in-place, walking, and running. Forceplates embedded in walkways have measured quantities related to the position and magnitude in relation to the fixed (forceplate) support surface for single strides during over ground walking and running. Using additional information on the position of a specified anatomical feature of the foot in relation to the forceplate support surface, the position of the center of force has also been determined in relation to a specified anatomical feature of the foot.

Human gait may be classified in general categories of walking and running. During walking, at least one foot is always in contact with the support surface and there are measurable periods of time greater than zero during which both feet are in contact with the support surface. During running, there are measurable periods greater than zero during which time neither foot is in contact with the support surface and there are no times during which both feet are in contact with the support surface.

Walking can be separated into four phases, double support with left leg leading, left leg single support, double support with right leg leading, and right leg single support. Transitions between the four phases are marked by what are generally termed "heel-strike" and "toe-off" events. The point of first contact of a foot is termed a "heel-strike", because in normal adult individuals the heel of the foot (the rearmost portion of the sole when shoes are worn) is usually the first to contact the surface. However, heel-strike may be achieved with other portions of the foot contacting the surface first. During running normal adult individuals sometimes contact with the ball of the foot (forward portions of the sole when shoes are worn). Individuals with orthopedic and/or neuromuscular disorders may always contact the surface with other portions of the foot or other points along the perimeter of the sole when shoes are worn. Similarly, while the ball and toes of the foot are the last to contact the surface at a toe-off event in normal adults, a patient's last point of contact may be another portion of the foot. Thus, regardless of the actual points of contact, the terms heel-strike and toe-off refer to those points in time at which the foot first contacts the support surface and ceases to contact the support surface, respectively.

Treadmills allowing a subject to replicate walking and running speeds within a confined space have been described, for example, in U.S. Pat. No. 5,299,454 to Fuglewicz et al. and U.S. Pat. No. 6,010,465 to Nashner. A treadmill allows the difficulty of gait to be precisely set by independently controlling the belt speed and the inclination of the belt; however, prior art devices known to the inventors have not allowed for the slope to be changed from an incline to a decline (or a decline to an incline) while an individual is using the treadmill. The subject can be maintained in a fixed position relative to the measuring surface underlying the treadmill belt by coordinating the speed of gait with the speed of the treadmill belt movement.

It is sometimes desirable to determine the position of the center of force in relation to coordinates of specified anatomical features of the foot when the foot is in contact with a surface which is moving in relation to a fixed force sensing surface. This occurs, for example, when the foot is contacting the moving belt of a treadmill which overlays a force sensing surface. To determine the position of the center of force in relation to coordinates of the specified anatomical features of the foot, two coordinate transformations are performed. One, the position of the center of force is determined in relation to coordinates of the moving treadmill belt. Two, the position of the moving treadmill belt is determined in relation to coordinates of the specified anatomical feature of the foot. To perform the first of these coordinate transformations requires knowledge of the treadmill belt position in relation to the fixed force sensing surface position on a continuous basis. To perform the second of these two coordinate transformations requires knowledge of the position of the specified anatomical features of the foot in relation to the treadmill belt. Since the position of the foot and its anatomical features does not change in relation to the treadmill belt following each heel-strike event and before the subsequent toe-off of that foot, the position of the specified anatomical features of the foot needs be determined only once at heel-strike for each step.

One method to determine the position of the treadmill belt on a continuous basis in relation to the fixed force sensing surface is to use one of several sophisticated commercial treadmill systems described in the prior art which measure the anteroposterior speed of the moving treadmill belt on a continuous basis, and which provide the means to regulate the belt anteroposterior speed on a continuous basis. When one of these treadmill systems is used, the information necessary to determine the continuous position of the treadmill belt in relation to the underlying forceplate is obtained by performing mathematical integration of the belt speed signal on a continuous basis.

There are methods described in the prior art which can be used to determine, at the time of heel-strike, the position of the moving treadmill belt in relation to the specified anatomical features of the foot. One method is to use one of several commercially available optical motion analysis systems. Two examples of commercially available motion analysis systems which describe applications for tracking the motions of identified points on the human body during locomotion include the ExpertVision system manufactured by MotionAnalysis Corp., Santa Rosa, Calif. and the Vicon system manufactured by Oxford Medilog Systems, Limited, Oxfordshire, England. In accordance with this method, one or more optical markers are placed on the specified anatomical features of the foot. One or more additional markers are placed on the treadmill belt at predetermined positions. The number and placement of the optical markers on the anatomical feature and the treadmill belt determine the accuracy of the measurement as specified by the systems manufacturers. At the time of heel-strike, the positions of the treadmill belt marker or markers are then determined in relation to the positions of the anatomical feature marker or markers in accordance with methods specified by the system manufacturer.

There have been numerous proposals and/or attempts to equip endless belts in an attempt to measure the loads applied when an individual walks. These systems involve fitting force meters between the base over which one side of the endless belt travels and the chassis. However, such proposals and/or attempts have several drawbacks. First, the measurement cannot differentiate between the force exerted by each leg; this poses relatively few problems when analyzing running motion because both feet practically never touch the ground simultaneously since contact is essentially one-footed but it is an important shortcoming when the individual is walking because both feet always touch the ground since contact is two-footed as discussed above. Second, it is impossible to measure tangential forces in the x-axis and y-axis. Third, most studies have made a conscious decision not to try to capture the forces and torques in the horizontal plane caused by a footfall, probably given the relatively small contribution these forces have on the overall force analysis when compared to the vertical force.

U.S. Pat. No. 5,299,454 to Fuglewicz et at. and U.S. Pat. No. 6,010,465 to Nashner disclose a solution whereby the endless belt has a path around at least two forceplates in tandem. This solution has the inherent problem in that when the individual has both feet on the belt at the same time, the horizontal forces from one foot cancel out the horizontal forces of the other foot because belt is pushed in opposite directions by the two feet. The other solution using a treadmill structure with multiple forceplates is discussed, for example, in U.S. Pat. No. 6,173,608 to Belli et al., which discloses a treadmill structure that has a pair of belts running in the longitudinal direction. The inherent problem with this structure is that the normal walking or running gait for people eventually places the feet one in front of each other such that the individual would wind-up having heel-strikes over the gap between the belts and thus register forces on both belts at the same time, which defeats the purpose of the device.

The prior art has not described devices and methods for separately determining quantities related to the three-dimensional forces exerted by each foot against the treadmill support surface at all phases of the step cycle during walking.

III. SUMMARY OF THE INVENTION

This invention provides a treadmill system that is able to address the problems of the prior art.

According to one aspect of the invention, a force sensing treadmill including a chassis, a pair of treadmill units connected to the chassis such that the treadmill units are arranged in tandem and each of the treadmills having a belt, and a forceplate in communication with the belt.

According to one aspect of the invention, an apparatus for providing a plurality of signals representing forces and torques in the x-axis, y-axis, and z-axis resulting from contact between a foot and the apparatus, the apparatus including a support structure, a front treadmill unit connected to the support structure, the front treadmill having a plurality of rollers, a belt in communication with the plurality of rollers, a drive system in communication with at least one of the plurality of rollers, and a forceplate in communication with the belt; and a rear treadmill unit connected to the support structure, the rear treadmill unit having a plurality of rollers, a belt in communication with the plurality of rollers, a drive system in communication with at least one of the plurality of rollers, and a forceplate in communication with the belt; and wherein the front treadmill and the rear treadmill are in tandem to each other, and the forceplates measure $F_x$, $F_y$, $F_z$, $M_x$, $M_y$, and $M_z$ for each heel-strike.

According to one aspect of the invention, an apparatus for providing a plurality of signals representing forces and torques in the x-axis, y-axis, and z-axis resulting from contact between a foot and the apparatus, the apparatus including a support structure, a front treadmill unit connected to the support structure, the front treadmill having a plurality of rollers, a bell in communication with the plurality of rollers, a motor in communication with at least one of the plurality of rollers, and a forceplate in communication with the belt; and a rear treadmill unit connected to the support structure, the rear treadmill unit having a plurality of rollers, a belt in communication with the plurality of rollers, a motor in communication with at least one of the plurality of rollers, and a forceplate in communication with the belt; and wherein the front treadmill and the rear treadmill are in tandem to each other.

An aspect according to the invention is minimizing the gap between two tandem treadmill units so that the gap does not interfere with a normal walking or running gait, or distract the individual on the treadmill and to reduce its impact as a safety hazard.

An objective of the invention is to have a stable treadmill that is not subject to perceptibly swaying or vibration during use.

An objective of the invention is to have a variety of speeds possible and have close synchronization between the two treadmills.

An objective of at least one embodiment of the invention is to have a treadmill capable of allowing both uphill and downhill activities to be studied during one continuous session and providing a variety of grades.

An objective of the invention is that the treadmill is able to handle large loads to allow for testing of a variety of individuals including encumbered individuals.

An objective of the invention is that it is able to measure $F_x$, $F_y$, $F_z$, $M_x$, $M_y$, and $M_z$ on both treadmill units while providing the signals to an external component. The invention also should be able to measure the center of pressure on both treadmill units.

An objective of at least one embodiment of the invention is allowing sufficient portability around the inside of a laboratory and allows for transportation to other locations external to the laboratory.

An objective of at least one embodiment of the invention is that the structure will not interfere with a motion capture system used for video analysis of movement.

Another objective of the invention is improved efficiencies in research and gathering data other prior art methods and devices both in terms of the number of subjects, the number of data points, and the quality of data.

An advantage of the invention is that it is capable of measuring $F_x$, $F_y$, $F_z$, $M_x$, $M_y$, and $M_z$ on both treadmill units.

An advantage of the invention is that it does not interfere with the normal gait of an individual anymore than a one belt treadmill system.

An advantage of the invention is that it is able to separate the forces caused by each foot from the forces caused by the other foot.

Given the following enabling description of the drawings, the apparatus should become evident to a person of ordinary skill in the art.

IV. BRIEF DESCRIPTION OF THE DRAWINGS

The use of cross-hatching or shading within these drawings should not be interpreted as a limitation on the potential materials used for construction. Like reference numerals in the figures represent and refer to the same element or function.

FIG. 1 illustrates a top view of a preferred embodiment according to the invention.

FIGS. 2(*a*) and (*b*) depict side views of the treadmill unit components according to the invention.

V. DETAILED DESCRIPTION OF THE DRAWINGS

Figure 11:
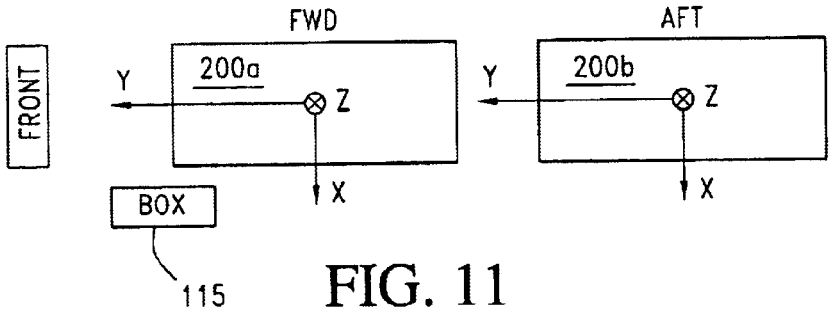
FIG. 11 depicts a block diagram representation of the forces and torques measured by an embodiment of the invention.

The present invention preferably is a treadmill for measuring $F_x$, $F_y$, $F_z$, $M_x$, $M_y$, and $M_z$ for each foot individually as illustrated in the block diagram shown in FIG. 11. The treadmill preferably includes a support structure (or means for providing support or chassis) 100 and two treadmill units 200*a*, 200*b* in tandem within the support structure 100 such that an individual is able to, for example, run or walk on the top surface of each treadmill unit 200*a*, 200*b* as illustrated, for example, in FIG. 1. More preferably, the gap 300 present between the tandem treadmill units 200*a*, 200*b* is minimized such that a foot usually easily passes from the front treadmill unit 200*a* to the rear treadmill unit 200*b* during use.

Figure 2A:
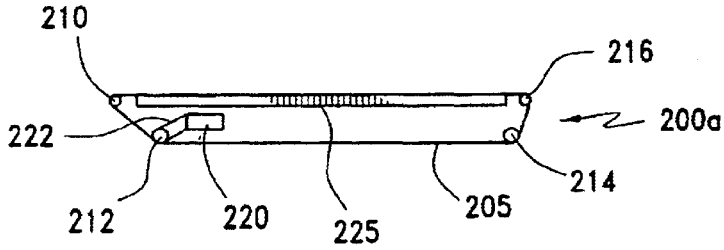
Figure 2B:
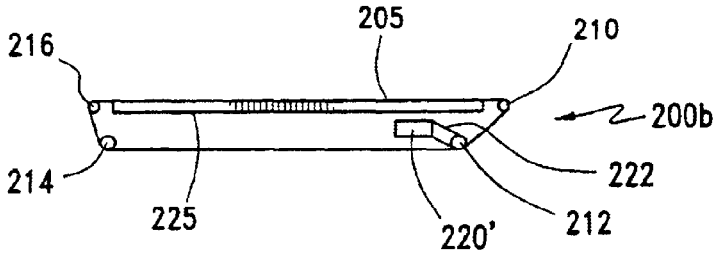

Each treadmill unit 200*a*, 200*b* preferably includes a belt (or movable support surface) 205, a plurality of rollers 210, 212, 214, 216, a drive system such as a motor 220, and a force sensing member such as a forceplate as illustrated, for example, in FIGS. 2(*a*) and (*b*). The forceplate preferably includes a plurality of transducers to detect the force applied by an individual's feet through the belt onto the forceplate; and more preferably there are four transducers each located in a respective corner of the forceplate 225. A suitable forceplate for use in this invention is manufactured by Advanced Mechanical Technologies, Inc. of Newton, Mass., which uses mechanically coupled multi-axis force transducers to measure all of the vertical axis, longitudinal horizontal axis, and lateral horizontal axis force components. The drive system 220 preferably drives roller 212 via a pulley 222.

Figure 1:
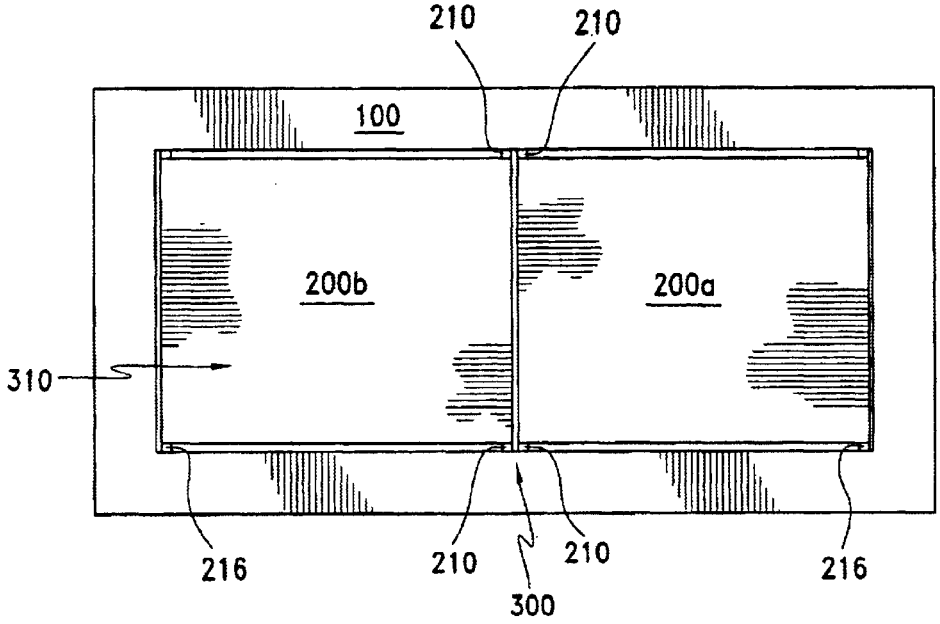

The plurality of rollers preferably number four to support the belt as illustrated, for example, in FIGS. 1–2(*b*). The roller 210 along the top surface nearest the other tandem treadmill unit preferably has a small diameter to further minimize the space 300 between the tandem treadmill units because the radius of the roller 210 is small (particularly when compared to the other rollers 212, 214, 216) which decreases the distance across the gap 300.

Preferably, the two treadmill units 200*a*, 200*b* are in communication and jointly controlled such that the motor 220 in the front treadmill unit 200*a* is the master while the motor 220' in the aft (or rear) treadmill unit 200*b* is the follower. This relationship allows for the aft treadmill unit 200*b* to adjust its speed to match that of the front treadmill unit 200*a*. For example, when an individual has a heel-strike on the front treadmill unit 200*a*, a braking force is applied thus slowing the front treadmill unit 200*a* a bit which in turn will slow the aft treadmill unit 200*b* to match the speed, but as the front treadmill unit 200*a* is speeding back up the aft treadmill unit 200*b* will match the acceleration. This locking speed also occurs when the front treadmill unit 200*a* might increase in speed, resulting in the aft treadmill unit 200*b* increasing speed to match the resulting speed and the acceleration. Preferably, the motors 220, 220' are able to run the belts at a speed between 0 and 10 MPH (including the end points), while maintaining synchronicity in speed within 0.5%. The motors 220, 200' preferably are heavy duty servo control motors to allow for easier implementation of the invention.

The tandem treadmill units 200*a*, 200*b* form together a support surface 310 upon which an individual is able to travel at a variety of speeds that accommodate walking and running.

Figure 5:
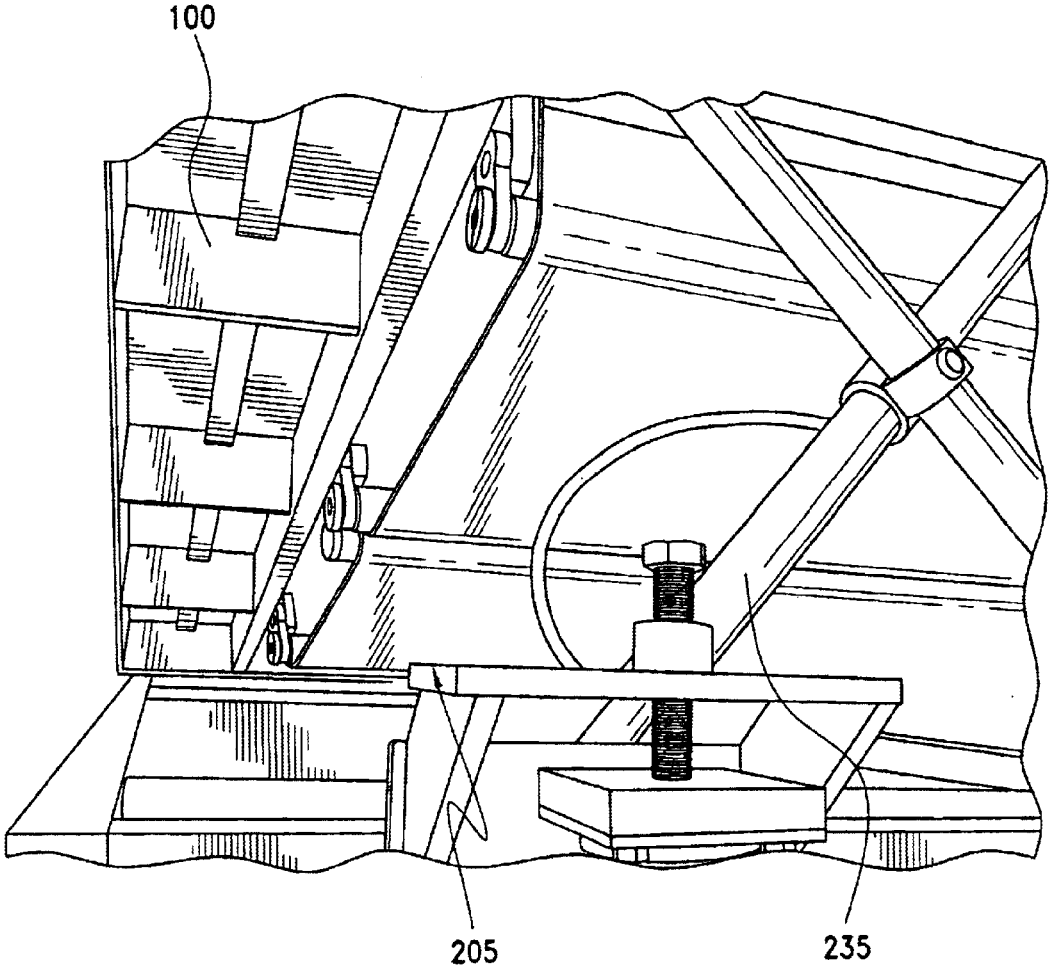
FIG. 5 illustrates a perspective view from underneath of an embodiment according to the invention.

The support structure 100 preferably includes the housing for both treadmill units 200*a*, 200*b*. The housing preferably encloses the treadmill units 200*a*, 200*b* around their respective exposed sides (i.e., the sides that do not face the other treadmill unit) as illustrated, for example, in FIGS. 1, 3, and 5. Alternatively, the housing may extend along the bottom sides of the treadmill units (not shown). The housing may include a rail (or safety handle) 110 along at least one edge of the support surface 310 of the treadmill units 200*a*, 200*b* as illustrated, for example, in FIGS. 6 and 7. The rail 110 in a further alternative embodiment may be detachable and relocatable, which is beneficial for studies that include filming the individual on the treadmill during a routine to compile 3-D images of the individual.

An alternative embodiment for the support structure is to add a connection hub 115 (shown, for example, in FIGS. 9 and 11) to provide a convenient place to run the wiring from the transducers, motor, and in other wiring within the treadmill. The connection hub 115 preferably has a plurality of jacks to connect to at least one external device for each of the internal wiring components.

Figure 7:
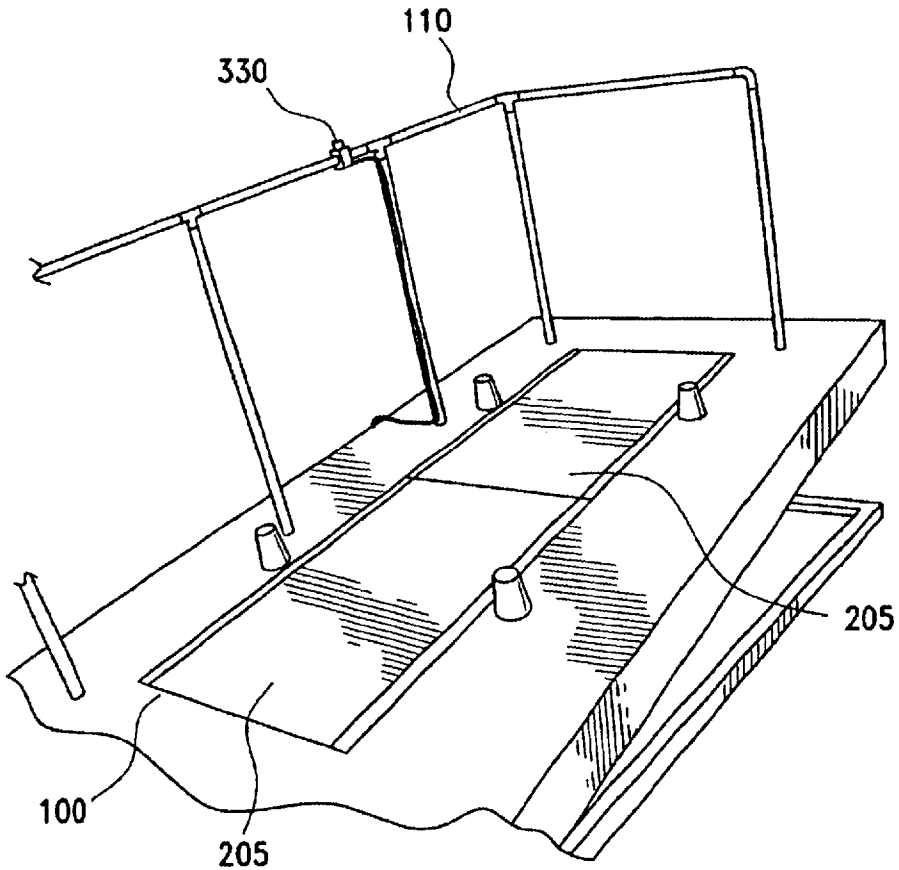
FIG. 7 illustrates a perspective rear view of an embodiment according to the invention in an inclined position.
Figure 6:
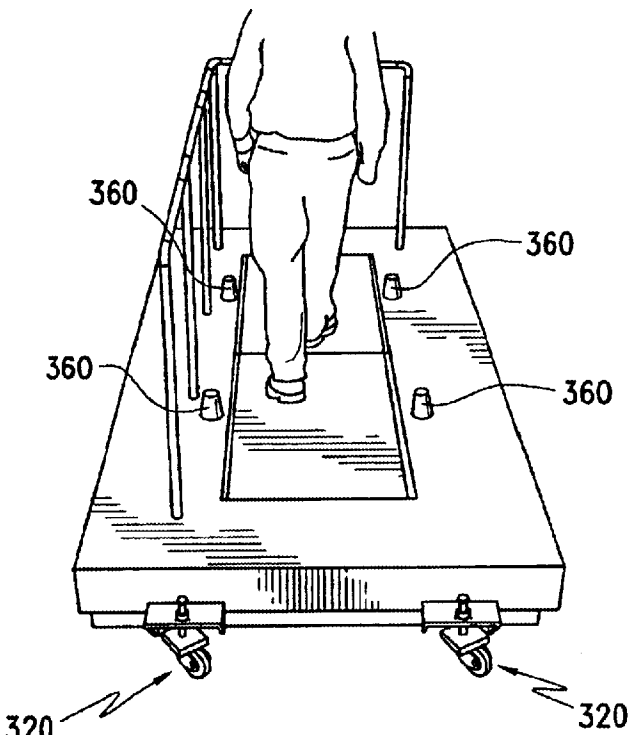
FIG. 6 depicts a rear view of an embodiment according to the invention in an inclined position during use.
Figure 8:
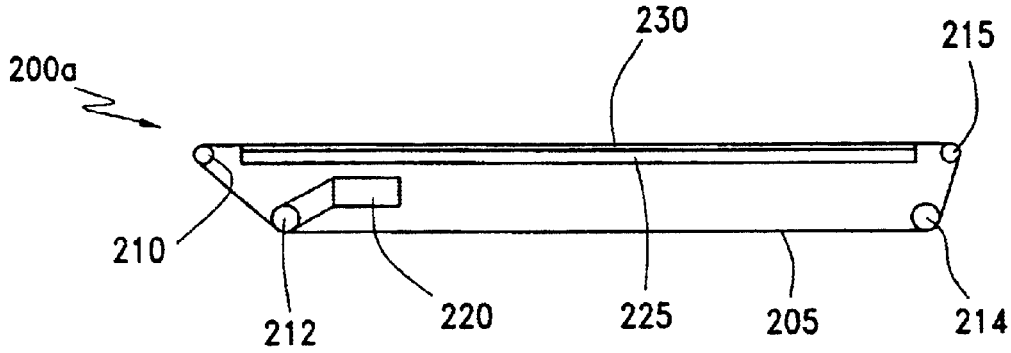
FIG. 8 illustrates a side view of the treadmill unit of an embodiment according to the invention.

An alternative embodiment for each of the treadmill units is to include a frictionless (or having minimal friction) material 230 between the belt 205 and the forceplate 225 as illustrated, for example, in FIGS. 6–8. The frictionless material 230 may, for example, be a solid piece such as a plate or a series of planks of frictionless material running laterally between the belt 205 and forceplate 225. Further, it would be preferable in this embodiment that the frictionless material 230 is easily replaced; and more preferably the material 230 is stiff to accurately and completely transfer the forces received from the belt 205 to the forceplate 225. This alternative embodiment would minimize wear on the forceplate 225 by the belt 205 and vice versa. This embodiment also will improve the transfer of the horizontal forces applied by an individual's foot on the belt 205 to the forceplate 225 by minimizing the effect of friction either adding to the force or more likely acting to cancel a portion of the horizontal forces (particularly the lateral forces).

Another alternative embodiment is to include a mechanism to change the grade of the treadmill surface from, for example, 0 to 25 percent grade. Preferably, the grade may allow for both an uphill and downhill capability while an individual is traversing the treadmill surface including changing between uphill and downhill during use. The preferred way to do this is by use of a jack mechanism 235 at the front and rear of the treadmill. More preferably, the jack structure is an X design with crossing legs driven with hydraulics as illustrated, for example, in FIGS. 5 and 9; however, other types of jack structures also would work. Further modification is to include a switch (not shown) that is tripped once one end is raised relative to the other end of the treadmill to prevent both ends being raised at once, where the switch is reset when the treadmill becomes level thus allowing an uphill segment to flow into a downhill segment. The jack(s) 235 preferably connects to the underside of the treadmill.

Figure 10:
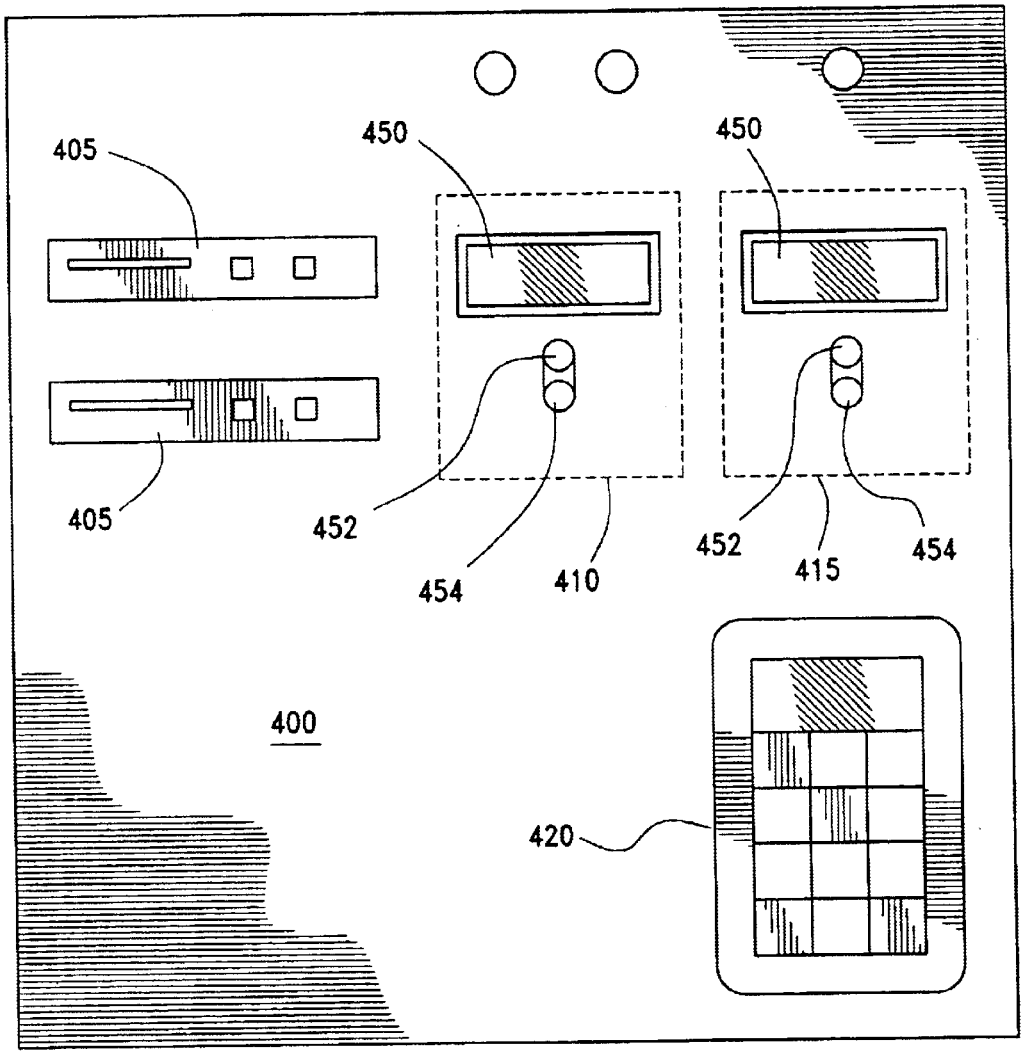
FIG. 10 illustrates an exemplary layout for an alternative embodiment of the invention.

A further modification to the above alternative embodiment or an alternative embodiment of its own is to include a podium 400 or other control interface such as a computer in the system as illustrated in FIG. 10. This arrangement allows for the programming of a course terrain in advance (or manual replication of it) in terms of inclines and declines that might be present in a particular course terrain. The podium 400 illustrated in FIG. 10 includes, for example, a pair of amplifiers 405, 405 (for amplifying the signal from the transducers in both treadmill units), a grade control 410, a speed control 415, a forward motor interface 420 that preferably is covered such that the display may be viewed but the motor not controlled, and a variety of other buttons associated with the operation of the treadmill units 200*a*, 200*b*. Each of the grade control 410 and speed control 415 preferably includes a display 450 to show the grade/speed currently for the treadmill and control buttons 452, 454 to increase/decrease the grade/speed of the treadmill.

Figure 3:
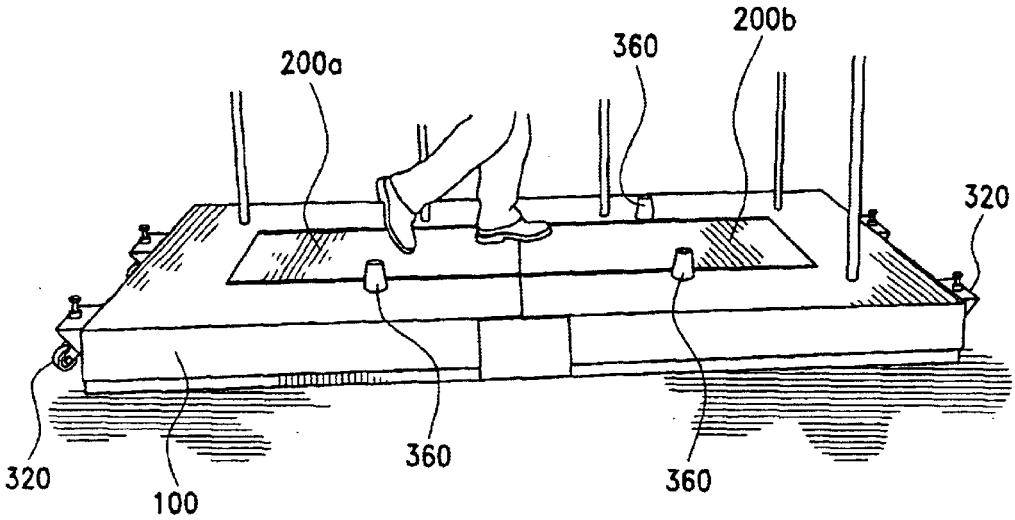
FIG. 3 illustrates a perspective top view of an embodiment according to the invention in use.
Figure 4:
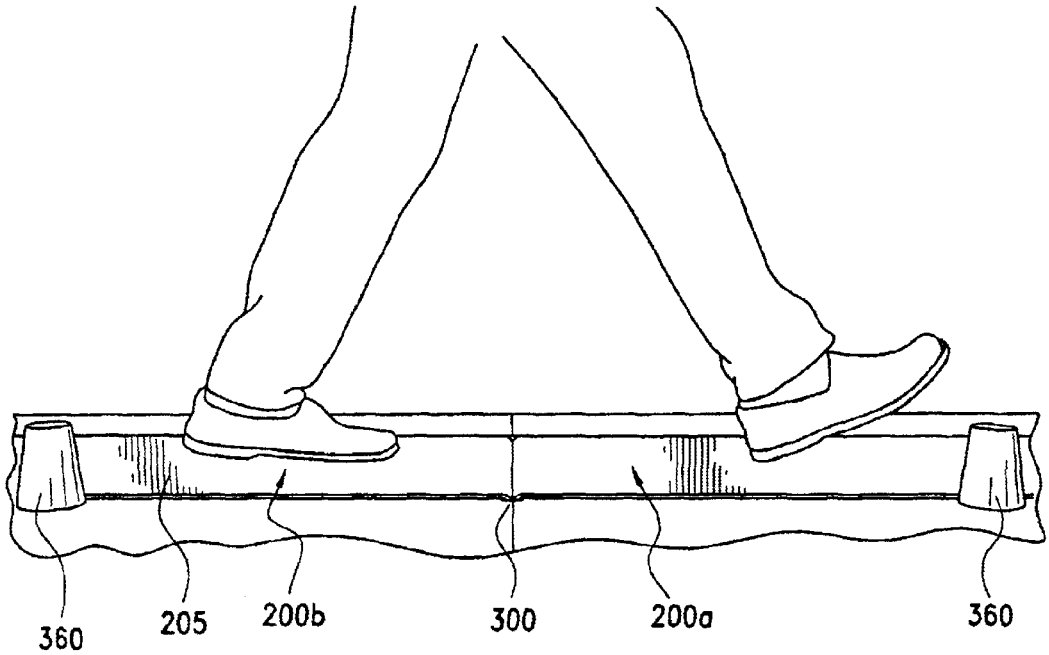
FIG. 4 depicts an individual walking on an embodiment according to the invention.
Figure 9:
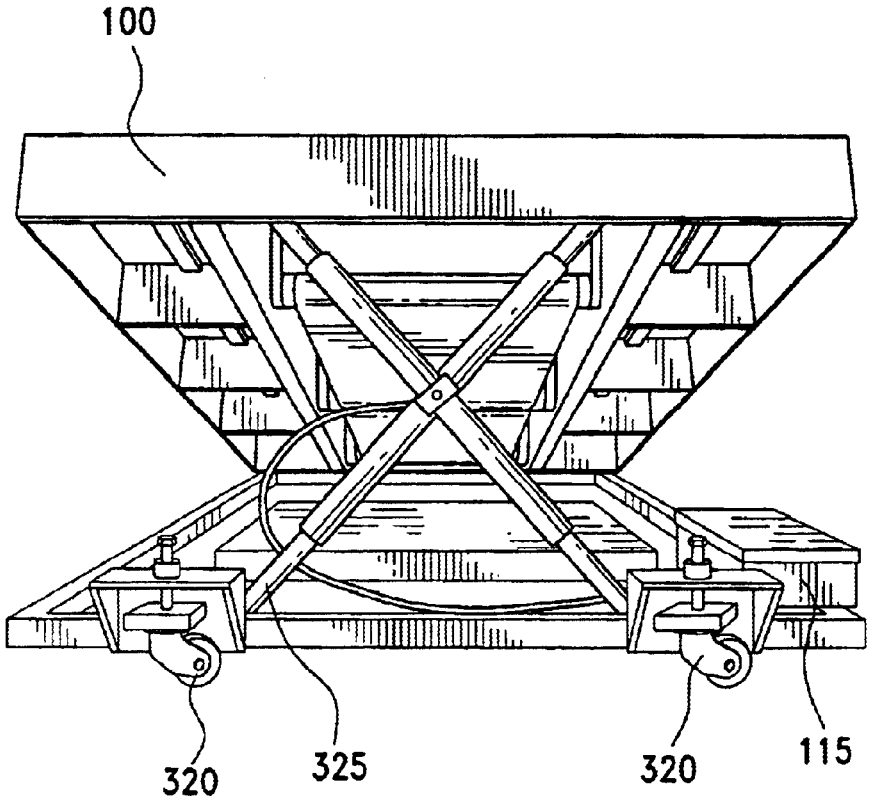
FIG. 9 depicts a front view of an embodiment according to the invention.

A further alternative embodiment is illustrated, for example, in FIGS. 3, 6, 9. This embodiment adds a plurality of wheels 320 to the treadmill, more preferably four wheels each of which is proximate to a corner of the treadmill to allow easy transport of the treadmill about the lab or other setting. The illustrated embodiment places a pair of wheels 320 at each end of the treadmill spaced from each other and spaced from the corners although the wheels may be more proximate to the corners. The wheels 320 preferably are capable of being retracted to avoid inadvertent movement of the treadmill. In the illustrated embodiment in FIGS. 3, 6, and 9, the wheels 320 are retracted by screwing them up from the floor. The wheels 320 preferably extend out from the housing.

A still further alternative embodiment is to include a kill switch 330 on the treadmill that the individual may use to stop the treadmill. An illustrative kill switch is shown in FIGS. 6 and 7 as a push button switch 330 with wires then running down to the treadmill. Alternatively, a pull strap, which when pulled activates the kill switch, may be used in addition or as a substitute to the push button.

A still further alternative embodiment is to include a plurality of reflective material on the housing to assist with analysis of video and image capture of an individual during use of the treadmill. Exemplary locations for the reflective material are illustrated at 360 in FIGS. 3, 4, 6, and 7.

Although the present invention has been described in terms of particular preferred embodiments, it is not limited to those embodiments. Alternative embodiments, examples, and modifications which would still be encompassed by the invention may be made by those skilled in the art, particularly in light of the foregoing teachings. The preferred and alternative embodiments described above may be combined in a variety of ways with each other. Furthermore, the dimensions, shapes, sizes, and number of the various pieces illustrated in the Figures may be adjusted from that shown.

Furthermore, those skilled in the art will appreciate that various adaptations and modifications of the above-described preferred embodiments can be configured without departing from the scope and spirit of the invention. Therefore, it is to be understood that, within the scope of the appended claims, the invention may be practiced other than as specifically described herein.

We claim:

1. An apparatus for providing a plurality of signals representing forces and torques in the x-axis, y-axis, and z-axis resulting from contact between a foot and said apparatus, said apparatus comprising:

a support structure, a front treadmill unit connected to said support structure, said front treadmill having a plurality of rollers, a belt in communication with said plurality of rollers, a motor in communication with at least one of said plurality of rollers, and a forceplate in communication with said belt; and a rear treadmill unit connected to said support structure, said rear treadmill unit having a plurality of rollers, a belt in communication with said plurality of rollers, a motor in communication with at least one of said plurality of rollers, and a forceplate in communication with said belt; and wherein said front treadmill and said rear treadmill are in tandem to each other.

2. The apparatus according to claim 1, further comprising a railing connected to said support structure.

3. The apparatus according to claim 1, wherein said support structure includes a wiring connection hub for connecting to at least one external device.

4. The apparatus according to claim 1, further comprising at least one jack mechanism connected to said support structure.

5. The apparatus according to claim 1, wherein each of said front and rear treadmill unit includes reduced friction material between said belt and said forceplate.

6. The apparatus according to claim 1, wherein each of said front and rear treadmill units include reduced friction material between said belt and said forceplate.

7. The apparatus according to claim 1, further comprising a plurality of wheels attached to said support structure.

8. The apparatus according to claim 1, wherein said forceplates measure $F_x$, $F_y$, $F_z$, $M_x$, $M_y$, and $M_z$ for each heel-strike.

9. The apparatus according to claim 1, further comprising a kill switch in communication with said motors.

10. The apparatus according to claim 1, wherein said motor of said rear treadmill unit follows the speed and acceleration of said motor of said front treadmill unit.

11. The apparatus according to claim 1, wherein said front treadmill unit and said rear treadmill unit are spaced from each other such that a gait of an individual is unaffected.

12. The apparatus according to claim 1, further comprising a plurality of reflective material spaced around the perimeter of said front and rear treadmill units.

13. An apparatus for providing a plurality of signals representing forces and torques in the x-axis, y-axis, and z-axis resulting from contact between a foot and said apparatus, said apparatus comprising:

a support structure, a front treadmill unit connected to said support structure, said front treadmill having a plurality of rollers, a belt in communication with said plurality of rollers, a drive system in communication with at least one of said plurality of rollers, and a forceplate in communication with said belt; and a rear treadmill unit connected to said support structure, said rear treadmill unit having a plurality of rollers, a belt in communication with said plurality of rollers, a drive system in communication with at least one of said plurality of rollers, and a forceplate in communication with said belt; and wherein said front treadmill and said rear treadmill are in tandem to each other, and said forceplates measure $F_x$, $F_y$, $F_z$, $M_x$, $M_y$, and $M_z$ for each heel-strike.

14. The apparatus according to claim 13, wherein said support structure includes a wiring connection hub for connecting to at least one external device.

15. The apparatus according to claim 13, further comprising at least one jack mechanism connected to said support structure.

16. The apparatus according to claim 13, wherein each of said front and rear treadmill unit includes reduced friction material between said belt and said forceplate.

17. The apparatus according to claim 13, wherein each of said front and rear treadmill unit includes reduced friction material between said belt and said forceplate.

18. The apparatus according to claim 13, further comprising a plurality of wheels attached to said support structure.

19. A treadmill research system comprising:

said apparatus according to claim 13, and a control center including a pair of amplifiers for amplifying the signal from each of said forceplates, a grade control, a speed control, and a forward motor interface.

20. A force sensing treadmill comprising:

a chassis, a pair of treadmill units connected to said chassis such that said treadmill units are arranged in tandem and each of said treadmills includes a belt, and a forceplate in communication with said belt.

21. The apparatus according to claim 1, wherein said forceplates measure $F_x$, $F_y$, $F_z$, $M_x$, $M_y$, and $M_z$ of each foot exerted against the belt during the entire time each foot is in contact with the belt.

* * * * *